US005522318A

United States Patent [19]

Gladden et al.

[11] Patent Number: 5,522,318

[45] Date of Patent: Jun. 4, 1996

[54] CUSHION ELEMENT FOR DETONATORS AND THE LIKE; APPARATUS AND METHOD OF ASSEMBLY

[75] Inventors: Ernest L. Gladden; Thomas A. Nadeau, both of Granby; Raymond T. Overstrom, Glastonbury, all of Conn.

[73] Assignee: The Ensign-Bickford Company, Simsbury, Conn.

[21] Appl. No.: 376,063

[22] Filed: Jan. 20, 1995

Related U.S. Application Data

[63] Continuation of Ser. No. 608,688, Nov. 5, 1990, abandoned, and Ser. No. 954,878, Sep. 30, 1992, abandoned.

[51] Int. Cl.[6] ..... F42B 3/16

[52] U.S. Cl. ..... 102/202.13; 102/202.7; 102/202.14

[58] Field of Search ..... 102/202.7, 202.9, 102/202.13, 202.5, 202.8, 202.11, 202.14, 202.4

[56] References Cited

U.S. PATENT DOCUMENTS

| | | | |
|---|---|---|---|
| 720,073 | 2/1903 | Schmitt et al. | 102/202.11 |
| 1,704,222 | 3/1929 | Schuricht et al. | 102/202.14 |
| 2,429,490 | 10/1947 | Scherrer | 102/202.13 |
| 2,471,381 | 5/1949 | Yurick et al. | 102/202.5 |
| 2,772,633 | 12/1956 | Barocca | 102/202.14 |
| 3,937,143 | 2/1976 | Schlueter | 102/202.11 |
| 3,981,240 | 9/1976 | Gladden | 102/202.4 |
| 4,821,646 | 4/1989 | True et al. | 102/202.9 |
| 4,881,463 | 11/1989 | Ninio et al. | 102/202.2 |
| 5,003,879 | 4/1991 | Jones | 102/204 |
| 5,031,538 | 7/1991 | Dufrane et al. | 102/275.5 |

FOREIGN PATENT DOCUMENTS

| | | | |
|---|---|---|---|
| 199107 | 8/1958 | Austria | 102/202.11 |
| 196278 | 10/1986 | European Pat. Off. | 102/202.14 |
| 776854 | 6/1957 | United Kingdom | 102/202.11 |

OTHER PUBLICATIONS

Webster, New International Dictionary, 1950, definition with regard to explosive and membrane.

*Primary Examiner*—Stephen M. Johnson
*Attorney, Agent, or Firm*—Victor E. Libert

[57] ABSTRACT

An improved detonator includes a housing having an open end and an opposite, closed end and defining an axially-extending channel of the housing. A cushion element containing at least one aperture is disposed within the channel and is provided with a resilient, pliable and shock absorbent surface for contacting and retaining explosive material at the closed end of the detonator housing. The cushion element has a signal communicating membrane covering its at least one aperture for passage therethrough of an initiating signal to the explosive material. A method for assembling the detonator includes inserting explosive material into the axially extending channel of the detonator housing, inserting a cushion element having a signal communicating membrane into the channel, and pressing the cushion element towards the closed end of the housing for compacting the explosive material between the cushion element and the closed end of the housing.

10 Claims, 4 Drawing Sheets

CUSHION ELEMENT FOR DETONATORS AND THE LIKE; APPARATUS AND METHOD OF ASSEMBLY

This is a continuation of application Ser. No. 07/608,688 filed Nov. 5, 1990 now abandoned and its continuation Ser. No. 07/954,878 filed on Sep. 30, 1992 now abandoned.

FIELD OF INVENTION

This invention generally relates to devices for amplifying and transmitting a blast initiation signal, and more particularly to an improved detonator construction and method of assembly.

BACKGROUND OF THE INVENTION

In blasting operations, a variety of electric and non-electric devices may be used to amplify and transmit a blast initiation signal including detonators, ignitors, delay detonators, initiators and the like. As used herein, the term "detonator" is intended to generally refer to the variety of devices which amplify and transmit an initiating signal.

Detonators are generally comprised of an elongated tubular housing closed at one end and open at the other end, and contain one or more pyrotechnic or explosive charges positioned within the housing adjacent the closed end.

The output of the detonator is proportional to the density and quantity of the explosives as well as their chemical composition and, therefore, a small diameter press pin is used to compress the explosives within the housing. To achieve the desired explosive density, pressing forces as high as 300 pounds (6,000 psi on a 0.254 inch OD pin) and higher may be used.

It has been found that many explosives are more sensitive to initiation by impact or friction if compaction energy is applied to the surface of the explosive using a hard surface. The degree of sensitization is a function of the hardness, i.e., increasing hardness causes increased sensitivity. Because of the high pressures required to achieve the desired detonator explosive density, pressing of explosive within the housing is usually accomplished using a press pin, typically steel in direct contact with the explosive, thereby causing sensitization of the explosive and increasing the hazard associated with pressing the explosive.

The combination of the hardness of the press pin, alignment of the tooling, the breaking of the explosive into smaller particles during compression, and the explosive being under high compression, provide conditions which, unless very carefully controlled, can lead to inadvertent and unwanted activation of the detonator.

Another potential mechanism for inadvertently initiating the detonator during compression of the explosive is displacement of small particles of explosive into the annular space between the pin and the housing as consolidation of the explosive occurs. As the press pin is in motion while being inserted into the housing, while pressing the explosive material or while being withdrawn from the housing, particles of explosive material trapped between the housing and the press pin surfaces are subjected to a substantial amount of friction which could lead to unwanted detonation.

After compression of the explosive within the housing, the detonator is usually shipped between manufacturing facilities as well as to the use site, and during such shipment, the detonators are subjected to vibration, shaking and shock which tends to loosen the compressed explosive material.

The loose particles of explosive are typically very sensitive to initiation by friction and static electricity and therefore present a safety hazard during transportation and subsequent handling of the detonator at the new location.

OBJECTS OF THE INVENTION

It is therefore a primary object of the invention to provide an improved detonator having increased resistance to inadvertent detonation during assembly of the detonator and which retains explosive materials compacted within a housing of the detonator during shipment and storage of the detonator.

It is another object of the invention to provide a cushion element for use with a detonator which reduces the opportunity for friction initiation of the detonator during compression of explosive materials within a housing of the detonator and which thereafter retains the explosive materials in the compressed location within the housing.

It is a further object of the invention to provide a cushion element for use with a detonator having a membrane-type signal communicating surface for reliable communication of an initiation signal to explosive materials of the detonator while at the same time enhancing the desired qualities of improved resistance to inadvertent detonation and improved ease of manufacture.

It is a still further object of the invention to provide an improved method of assembling one or more detonators which provides improved resistance to shock during manufacture, shipping, and other external sources and friction initiation of explosive materials during compression of the materials within the housing of a detonator and improved retention of the materials compressed within the housing.

Other objects will be in part obvious and in part pointed out in more detail hereinafter.

A better understanding of the objects, advantages, features, properties and relations of the invention will be obtained from the following description and accompanying drawings which set forth certain illustrative embodiments and are indicative of the various ways in which the principals of the invention are employed.

SUMMARY OF THE INVENTION

A device for amplifying and transmitting an initiating signal constructed according to the present invention comprises a tubular housing having an axial channel formed therein, the housing having a closed end and an open end opposite the closed end; compressed explosive material received in the channel and positioned against the closed end; a cushion element disposed within the channel in juxtaposition with, and substantially covering, the explosive material, the element having a pliable and shock absorbent surface facing the material, and in contact therewith for retaining the explosive material against the closed end; and a barrier-type signal communicating surface formed on the cushion element for communicating the signal to the explosive material.

In further accord with the present invention, the cushion element has a diametric interference fit with the housing interior side walls for retaining the compressed explosive material against the closed end.

In accordance with this invention, a new and improved method is disclosed which includes inserting explosive material into an axially extending channel of a tubular housing; inserting a cushion element having a signal communicating surface into the channel, the element covering the cross-section of the channel and having a diametric interference fit with the housing interior side walls; and pressing the element towards the closed end of the housing, thereby compacting the explosive material between the element and the housing closed end.

In further accord with the method of this invention, the housing is positioned in a vertical orientation with the closed end below the open end prior to inserting the explosive material into the channel, whereby residual explosive material adhering to the housing is dislodged by the element during pressing, and the materials thereafter fall by gravity towards the closed end.

In still further accord with the method of this invention, a plurality of accurately spaced, pre-cut or otherwise formed cushion elements are detachably supported by a sheet and each element is registered to align with the open end of one of a plurality of detonators for simultaneous insertion of the elements into the detonator housings.

DETAILED DESCRIPTION OF CERTAIN PREFERRED EMBODIMENTS

The cushion element of the present invention is particularly suited for use with a device for amplifying and transmitting a blast initiation signal, e.g., a detonator. The element provides a pliable and shock absorbent surface for contact with explosive material within the housing of the detonator which minimizes friction initiation of the material during compression within the housing, i.e., during manufacture, and which thereafter retains the material compressed within the housing and reduces the opportunity for shock initiation of the detonator during subsequent handling.

Figure 1:
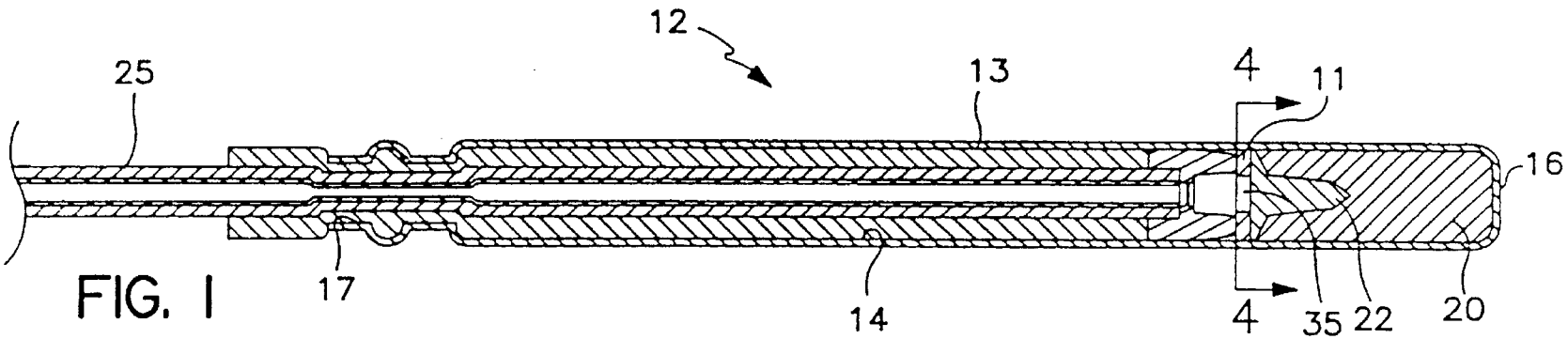
FIG. 1 is a longitudinal, cross-sectional view of a non-electric, instantaneous detonator having a cushion element of the present invention.

Referring to FIG. 1, a cushion element 11 of the invention is shown disposed within a non-electric, instantaneous detonator 12. The detonator comprises a generally tubular shaped housing 13 having an axially extending channel 14 formed therein, with a closed end 16 and an open end 17 opposite the closed end 16. As used herein, the term "channel" is intended to generally refer to the tubular enclosed passage defined by the interior surfaces or side walls of the tubular housing. A first charge (base charge) 20 of a secondary explosive is positioned within the channel. Charge 22 is positioned within the channel 14 in juxtaposition with the base charge 20.

The base charge 20 comprises a secondary explosive such as pentaerythritol tetranitrate (PETN) or cyclotrimethylenetrinitramine (RDX) to provide the principal output or signal amplifying capability of the device. The initiating charge 22 comprises a primary explosive such as lead azide, lead styphnate or diazodinitrophenol (DDNP). Such primary explosives are characteristically very sensitive to initiation by heat in the form of flame, spark, friction or impact, and serve to detonate in response to an initiating signal to activate the base charge.

The cushion element 11 is positioned in juxtaposition with the initiating charge 22, and is dimensioned to provide a slight diametric interference fit with the housing interior side walls. In the preferred embodiment, a 0.003 to 0.005 inch interference is considered adequate; however, the interference may vary depending on the material selected to form the cushion element to thereby provide the desired retention of the explosive materials within the channel.

The cushion element 11 should be made of an easily deformable form-sustaining material having a soft, pliable consistency for shock absorbence. The preferred element material is paper board; however, polymers such as polyethylene, rubber and polyurethane are also suitable element materials.

The normal functioning of the detonator requires that a signal transmission device transmit an initiating signal to be applied to the initiating charge 22 to cause it to detonate and thereby activate the base charge 20. The signal can take the form of a detonation shock wave from a shock tube 25, a deflagrating flame front from a deflagrating type tube, or detonating cord in a non-electric, instantaneous detonator 12 (FIG. 1). The signal can also take the form of a thermal pulse, such as from a pyrotechnic time delay element 27 in a delay detonator 28 (FIG. 2), or from an ignition charge 30 activated by a bridge wire 31 in both instantaneous and delay-type electric detonators 32 (FIG. 3), or an electric match.

Figure 6:
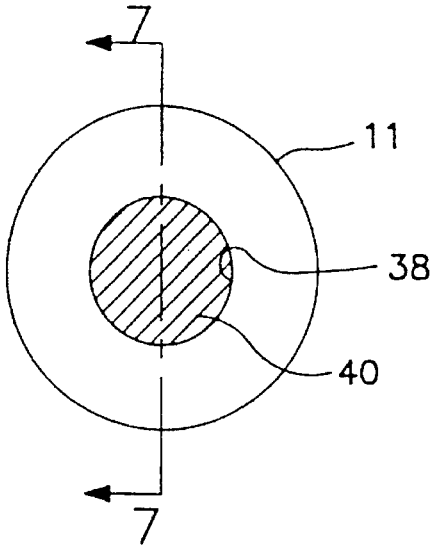
FIG. 6 is an enlarged view of an alternative embodiment of the cushion element of FIG. 4.
Figure 7:
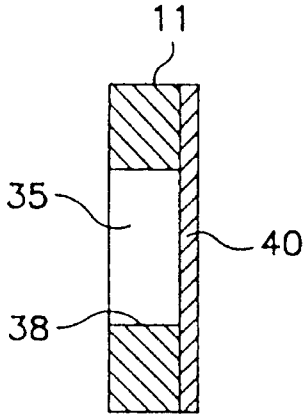
FIG. 7 is a cross-sectional view taken on line 7—7 of FIG. 6.
Figure 8:
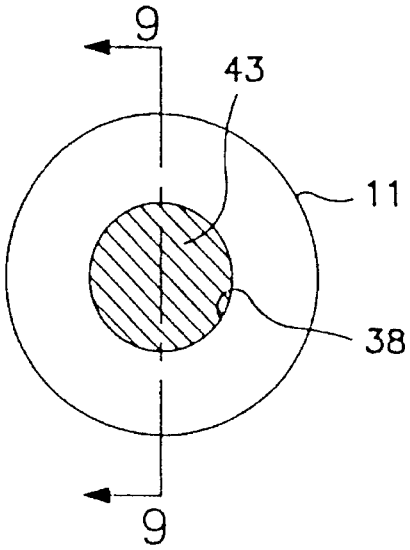
FIG. 8 is an enlarged view of an alternative embodiment of the cushion element of FIG. 5.
Figure 9:
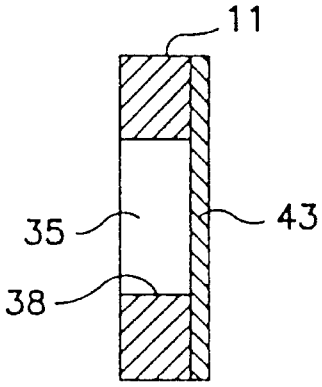
FIG. 9 is a cross-sectional view taken on line 9—9 of FIG. 8.

For reliable communication of the initiating signal to the initiating charge 22, a signal communicating surface 35 is formed in the cushion element. Referring to FIGS. 1, 4, 5, 6 and 7, the signal communicating surface comprises a structure having at least one hole with sufficient open space to allow the initiating signal to pass through to, and cause initiation of, the initiating charge 22. Additionally, the pattern should have sufficiently small hole size to thereby act as a barrier to retain the explosive materials 20, 22 against the closed end 16. The pattern may be formed by providing the element 11 with at least one central through hole 38 (FIGS. 4 and 5), or by providing the element 11 with a central through hole 38 covered by a mesh or screen 40 (FIGS. 6 and 7). Referring to FIGS. 8 and 9, the signal communicating surface 35 may also be formed by providing the element with a central through hole 38 covered by a thin membrane 43 which acts as a retaining barrier or membrane while allowing the initiating signal to pass through with sufficient ease that the reliability of initiating the explosive materials is not substantially reduced. Suitable membrane materials include thin, porous tissue paper adhered to a surface of the element 11, or other non-metallic woven materials capable of passing the initiating signal. Other membrane materials include non-porous inert films such as cellulose acetate, or self consuming materials, including high nitrogen content nitrocellulose, which decompose rapidly upon exposure to the initiating signal. All such membrane elements provide the desired improved shock resistance.

Figure 9A:
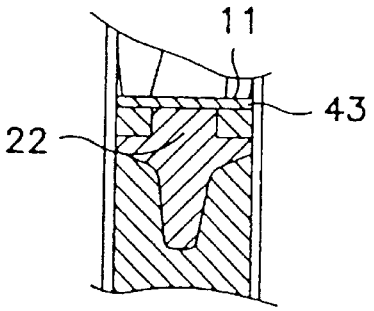
FIG. 9A illustrates the aperture in each cushion element filled by the initating charge.

For completeness, it is noted that the hole or aperture in cushion element 11, whether closed by screen 40 or membrane 43 or if a plurality of smaller holes is provided in cushion element 11, the space is filled by the initiating charge 22, typically, lead azide. Enlarged FIG. 9A shows that configuration with the membrane embodiment; such a "filled hole" feature was omitted from the other Figures for purposes of clarity in the other Figures.

Figure 10:
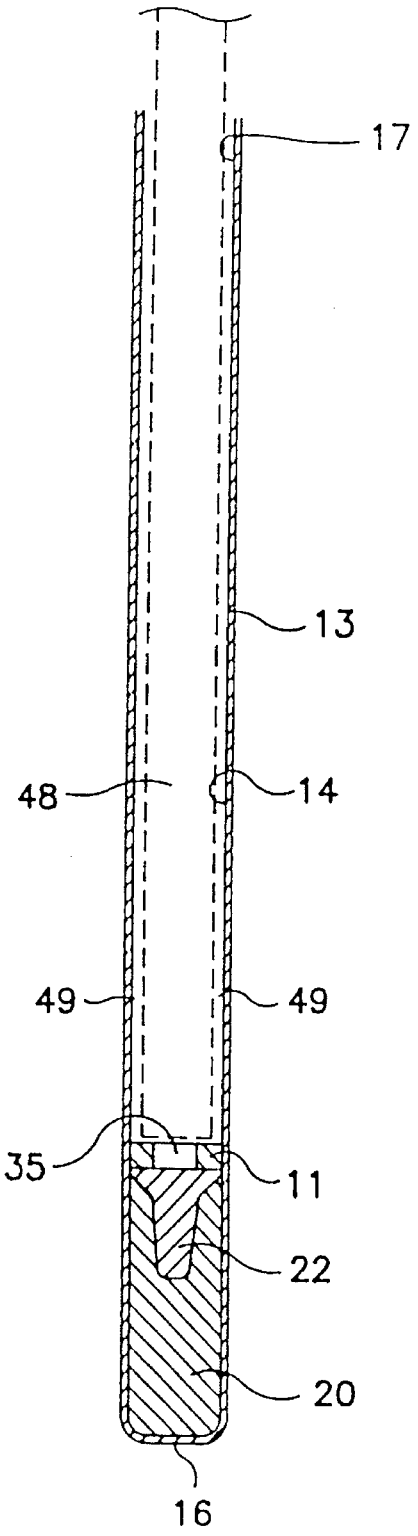
FIG. 10 is a longitudinal, cross-sectional view of a detonator being assembled with a cushion element of the invention, a press pin being shown in phantom.

Assembly of a detonator with the cushion element of the present invention greatly minimizes the inadvertent initiation of the detonator explosive material during assembly. Referring to FIG. 10, the base charge 20 and the initiating charge 22 are first positioned within the channel 14. The cushion element 11 is then inserted in the channel 14 and is pushed into position in juxtaposition with the initiating charge by action of a press pin 48. A small, annular channel 49 is formed between the press pin 48 and the housing 13 because of the clearance required to allow the pin 48 to be easily inserted and withdrawn from the housing. As the element 11 moves down the bore of the housing 13, the interference fit between the element and the housing dislodges any residual explosive material adhering to the housing within the channel, thus preventing any particles of explosive from becoming lodged in the annular channel 49 between the press pin 48 and the housing 13. The pressing operation occurs with the housing 13 oriented in a vertical or upright position with the closed end 16 positioned below the open end 17, and any loose explosive dislodged by the cushion element 11 during the pressing operation falls by gravity onto the yet unpressed explosive material.

As the cushion element 11 is inserted into the channel and pressed, the signal communicating surface 35 allows entrapped air to escape thereby preventing backpressure which could buckle or rupture the element. Additionally, the element acts as a filter, capturing small particles of explosive entrapped in the air stream, thereby preventing the explosive from contaminating the space above the element.

Continued insertion of the press pin 48 within the channel 14 will cause the cushion element 11 and the explosive material 20, 22 to become compressed against the closed end 16. The cushion element 11 maintains a separation between the press pin 48 and the initiating charge 22, and provides a pliable surface which minimizes friction while contacting the explosive material to achieve the high explosive density without the explosive material significantly contacting the hard surface of the press pin 48. Similarly, when use with a delay element, similar separation and protection between the delay element and powder is provided.

Once the desired compression force has been applied to the explosive material, the press pin 48 is withdrawn from the channel 14, and the cushion element 11 maintains the explosive material compressed within the housing. Additionally, no loose and unpressed explosive is left adhering to the sides of the housing within the channel, thereby eliminating the need to clean the housing internal surfaces and discard collected loose explosive material. The cushion element also minimizes the loosening of the explosive material caused by vibration and shaking of the detonators during shipment and storage.

It has been found that assembling a detonator with the cushion element of the invention greatly improves the resistance of the detonator to shock initiation, i.e., initiation caused by externally applied forces such as the shock wave from the detonation of an adjacent borehole, striking the detonator, etc. Test results indicate that a detonator assembled with a cushion element of the initiation is three (3) times more resistant to initiation by shock or impulse relative to a detonator assembled without a cushion element. Shock resistance is further improved where the cushion element is provided with a signal communicating surface 35, i.e., a membrane (FIG. 9). Test results further indicate that the cushion element of the invention with a membrane provides improved detonator shock resistance over prior art detonators specifically designed for improved shock resistance.

Figure 2:
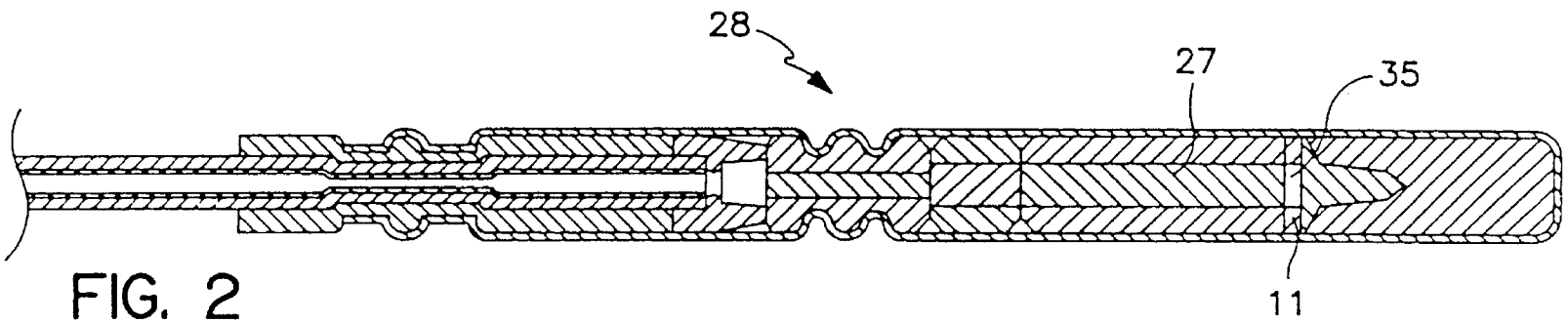
FIG. 2 is a longitudinal, cross-sectional view of a non-electric, delay detonator having the cushion element of the present invention.
Figure 3:
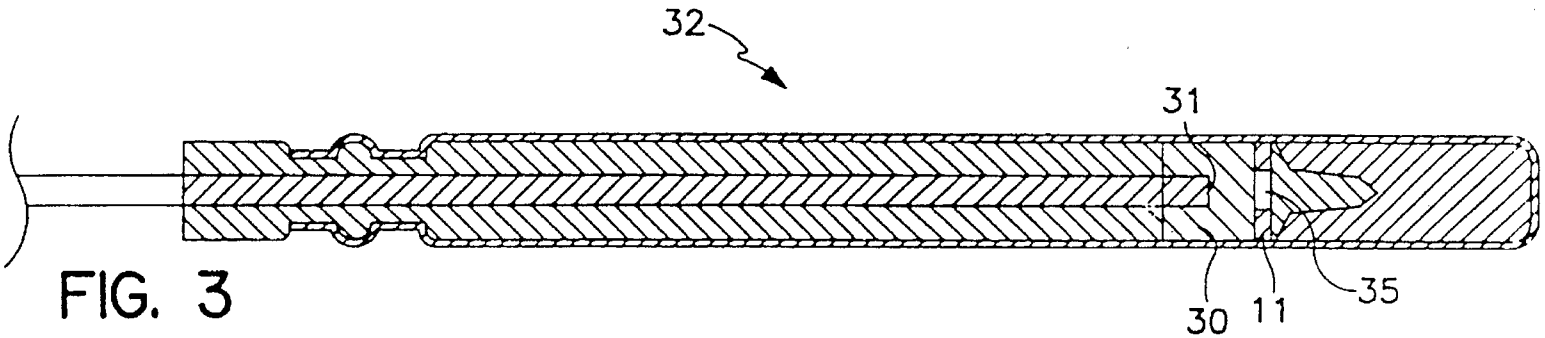
FIG. 3 is a longitudinal, cross-sectional view of an electric, instantaneous detonator having the cushion element of the invention.
Figure 4:
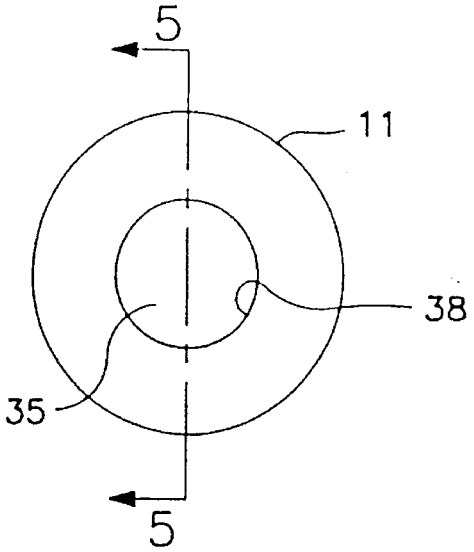
FIG. 4 is an enlarged view of the cushion element taken on line 4—4 of FIG. 1.
Figure 5:
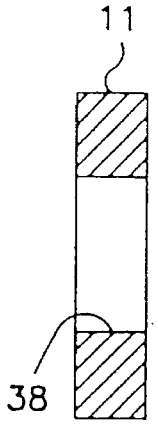
FIG. 5 is a cross-sectional view of the cushion element taken on line 5—5 of FIG. 4.

Referring to FIG. 2, it is often desirable to provide the detonator with a delay element 27. The delay element may be inserted into housing 13 immediately after insertion of the explosive materials and the cushion element 11. Compressive forces applied to the delay elements are transmitted through the delay elements to the cushion element and in turn to the explosive to cause consolidation of the explosive materials. Conversely, a detonator may be made by pressing the explosive via the cushion element to cause consolidation of the explosive material and then inserting the delay element which can be pressed onto the cushion element, further seating the delay element against the cushion element and simultaneously consolidating the explosive material. Because loose particles of explosive material are substantially eliminated during the pressing process by the cushion element 11, inadvertent initiation of the detonator caused by friction ignition of particles of explosive trapped between the housing and sides of the delay element during insertion of the delay element within the detonator is substantially eliminated. Additionally, the elimination of loose particles of explosive material reduces premature initiation of the detonator by explosive material between the delay element and the housing which would allow the initiating signal to bypass the delay element.

Figure 11:
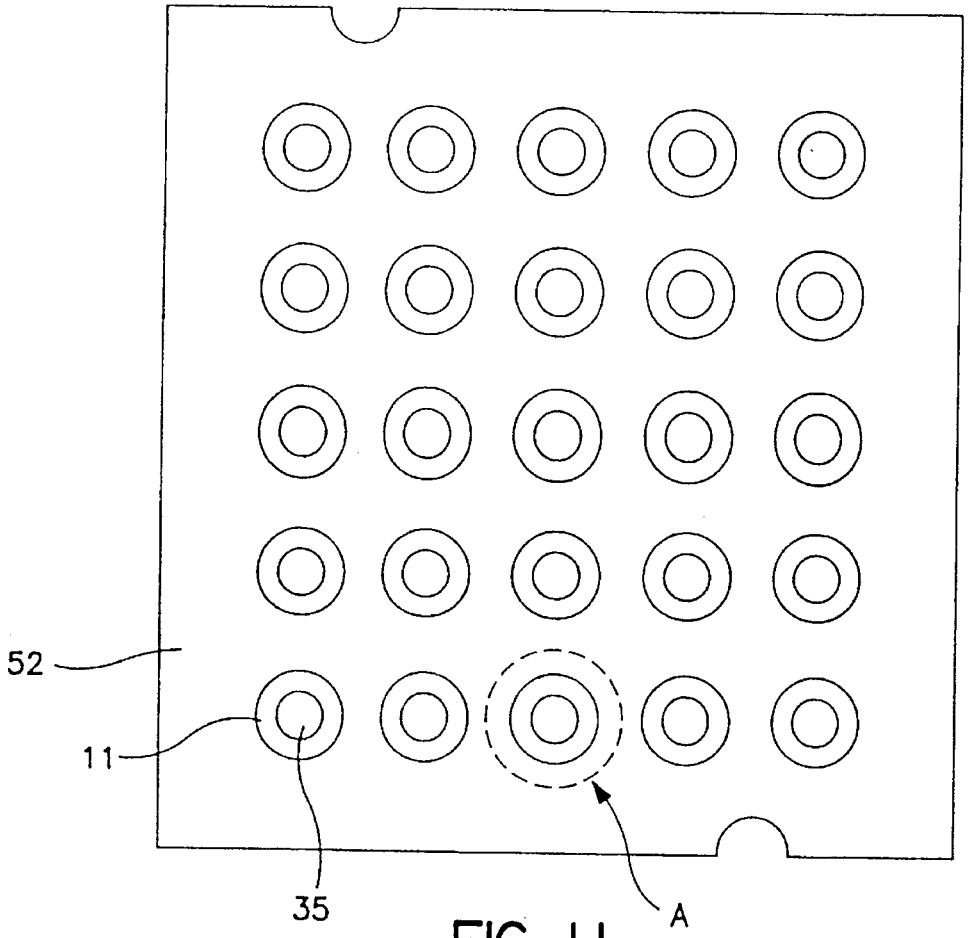
FIG. 11 is a top plan view of a sheet containing a plurality of cushion elements of the invention.
Figure 12:
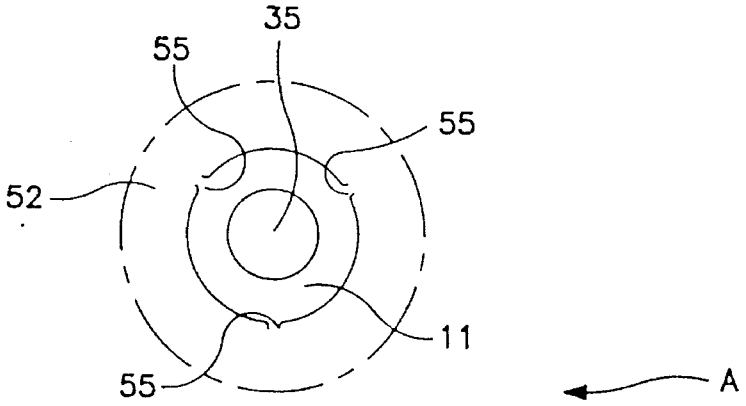
FIG. 12 is an enlarged view of detail A of FIG. 11.

For ease of assembly at a reduced cost, a plurality of detonators typically are simultaneously assembled in an automated assembly process using a process block (not shown) which can accommodate from 50 to 500 housings. After placement of the housings in the process block, explosive material is inserted into the channel of each housing for subsequent compression. The cushion element of the present invention is well suited for use in such an automated assembly process. Referring to FIGS. 11 and 12, a plurality of cushion elements 11 may be die cut from fiber board or molded of plastic in a sheet pattern 52 wherein each element is maintained and positioned in the sheet in a pattern that conforms to the pattern of the process block (not shown). The sheet 52 is then placed above the detonators with each element in the sheet registered to align with an open detonator end allowing the simultaneous compression of all the elements within the housings.

If the detonators include a delay element 27, delay elements may be positioned between each cushion element 11 and the press pin 48, and the compression force is thereafter applied directly to the delay element by the press pin as described hereinbefore.

Each element 11 is detachably held in the sheet 52 by one or more holding tabs 55 which have a reduced material thickness allowing them to easily break away under the force of a press pin 48 (FIG. 10).

The foregoing tab relationship has been found to work well with sheet card board but other means can be provided for detachability and other sheet materials can be used.

Although the invention has been illustrated and described with respect to exemplary embodiments thereof, it should be understood by those skilled in the art that the foregoing and various other changes, omissions and additions may be made therein and thereto, without departing from the spirit and scope of the invention.

We claim:

1. A detonator comprising:

a tubular housing having interior sidewalls which define an axially extending channel therein, said housing having a closed end and an open end opposite the closed end;

explosive material of a type which, upon detonation, amplifies and transmits exteriorly of the detonator an initiation signal received within the detonator, the explosive material being received in said channel and positioned against the closed end of the housing leaving an exposed face of the explosive material facing the open end of the housing;

a cushion element having at least one aperture extending therethrough and disposed within the channel remotely of the open end and in contact with and covering the exposed face of explosive material, the cushion element being substantially coextensive with the exposed face of the explosive material and the channel being dimensioned and configured so that during assembly of the detonator the cushion element is movable towards the closed end of the channel with such movement being resisted by the explosive material whereby such movement compacts the explosive material, the cushion element having a membrane covering the aperture in the cushion element; the membrane serving to prevent passage of explosive particles through the aperture of the cushion element and being permeable to the initiation signal to permit passage thereof through the membrane to the explosive material, for initiation of the explosive material to thereby amplify and transmit the initiation signal.

2. The detonator of claim 1 including a delay element having a first side and a second side and positioned within the channel between the open end of the housing and the cushion element with the second side of the delay element in juxtaposition with the cushion element, the delay element containing therein a pyrotechnic composition for delayed transmission of the initiation signal from the first to the second side of the delay element.

3. The detonator of claim 1 or claim 2 wherein the membrane is positioned on the side of the cushion element which is in contact with the explosive material.

4. The detonator of claim 1 or claim 2 wherein the membrane is positioned on the side of the cushion element which faces the open end of the housing.

5. The detonator of claim 1 or claim 2 wherein the membrane is air-permeable.

6. A detonator comprising:

a tubular housing having interior sidewalls which define an axially extending channel therein, said housing having a closed end and an open end opposite the closed end;

explosive material of a type which, upon detonation, amplifies and transmits exteriorly of the detonator an initiation signal received within the detonator, the explosive material being received in said channel and positioned against the closed end of the housing leaving an exposed face of the explosive material facing the open end of the housing;

a cushion element having at least one aperture extending therethrough and disposed within the channel remotely of the open end and in contact with and covering the exposed face of explosive material, the cushion element being substantially coextensive with the exposed face of the explosive material and having a diametric interference fit with the interior sidewalls of the housing for retaining the explosive material between the cushion element and the closed end of the housing both during manufacture of the detonator and thereafter, the channel being dimensioned and configured so that during assembly of the detonator the cushion element is movable towards the closed end of the channel with such movement being resisted by the explosive material whereby such movement compacts the explosive material; the cushion element having a membrane covering the aperture in the cushion element, the membrane serving to prevent passage of explosive particles through the aperture of the cushion element and being permeable to the initiation signal to permit passage thereof through the membrane to the explosive material, for initiation of the explosive material to thereby amplify and transmit the initiation signal.

7. The detonator of claim 6 including a delay element having a first side and a second side and positioned within the channel between the open end of the housing and the cushion element with the second side of the delay element in juxtaposition with the cushion element, the delay element containing therein a pyrotechnic composition for delayed transmission of the initiation signal from the first to the second side of the delay element.

8. The detonator of claim 1, claim 2 or claim 6 further comprising a signal transmission device terminating within the channel for transmitting the initiation signal into the housing and thence to the explosive material.

9. The detonator of claim 1, claim 2 or claim 6 wherein the cushion element is comprised of a pliable material.

10. The detonator of claim 1, claim 2 or claim 6 wherein the cushion element is comprised of fiberboard.

* * * * *

UNITED STATES PATENT AND TRADEMARK OFFICE

CERTIFICATE OF CORRECTION

PATENT NO. : 5,522,318
DATED : June 4, 1996
INVENTOR(S) : Ernest L. Gladden et al It is certified that error appears in the above-indentified patent and that said Letters Patent is hereby corrected as shown below:

Column 3, line 40, replace "6." with --6;--

Column 3, line 47, replace "initating" with --initiating--

Column 5, line 59, replace "use" with --used--

Column 7, line 27, after "housing;" insert --and--

Column 8, line 17, after "housing;" insert --and--

Signed and Sealed this

Twelfth Day of November, 1996

*Attest:*

*Attesting Officer*

BRUCE LEHMAN

*Commissioner of Patents and Trademarks*